US006906288B2

(12) United States Patent
Toedter et al.

(10) Patent No.: US 6,906,288 B2
(45) Date of Patent: Jun. 14, 2005

(54) METHOD AND DEVICE FOR CONTROLLING THE HEATING OF GLOW PLUGS IN A DIESEL ENGINE

(75) Inventors: Olaf Toedter, Woessingen (DE); Heinz-Georg Schmitz, Marbach/Neckar (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/680,414

(22) Filed: Oct. 8, 2003

(65) Prior Publication Data

US 2004/0118828 A1 Jun. 24, 2004

(30) Foreign Application Priority Data

Oct. 9, 2002 (DE) ..... 102 47 042

(51) Int. Cl.[7] ..... F23Q 7/00
(52) U.S. Cl. ..... 219/270; 123/145 A
(58) Field of Search ..... 219/270, 544, 219/490, 494; 123/145 A, 145 R; 361/264–266

(56) References Cited

U.S. PATENT DOCUMENTS 4,002,882 A * 1/1977 McCutchen ..... 219/499
4,726,333 A * 2/1988 Verheyen ..... 123/145 A
4,858,576 A * 8/1989 Jeffries et al. ..... 123/145 A
5,144,922 A * 9/1992 Kong ..... 123/145 A
5,499,497 A * 3/1996 DeFreitas ..... 60/776
5,724,932 A * 3/1998 Antone ..... 123/145 A
6,635,851 B2 * 10/2003 Uhl ..... 219/270

FOREIGN PATENT DOCUMENTS

DE 39 14 446 A1 11/1990
JP 2002-39043 * 2/2002

* cited by examiner

*Primary Examiner*—John A. Jeffery
(74) *Attorney, Agent, or Firm*—Nixon Peabody LLP; David S. Safran

(57) ABSTRACT

A process and device for controlling the heating of the glow plugs of a diesel engine. To be able to take into consideration the thermal behavior of the glow plugs while controlling the current supply of the glow plugs (3) of a diesel engine, the thermal behavior of the glow plugs (3) is emulated via a physical model. Formed on the corresponding output signal of the model (4), which is proportional to the glow plug temperature, is a reference signal, which as a control value, lies on the electronic control (12) controlling the heating flow of the glow plugs (3), which accordingly controls the heating of the glow plugs (3) using the actual glow plug temperature determined from emulation.

5 Claims, 2 Drawing Sheets

METHOD AND DEVICE FOR CONTROLLING THE HEATING OF GLOW PLUGS IN A DIESEL ENGINE

BACKGROUND OF THE INVENTION

1. Field of the Invention

The invention relates to a method and a device for controlling the heating of glow plugs in a diesel engine as are used to bring the glow plugs to a predetermined set point temperature at which the engine can be started.

2. Description of Related Art

The publication MTZ 10/2000 "Das elektronisch gesteuerte Glühsystem ISS für Dieselmotoren" [The electronically controlled ISS glow system for diesel engines] discloses a method for controlling the heating of glow plugs in a diesel engine. The glow command or glow requirement is issued after engine control initialization has been completed and after the temperature of the engine elements has been determined by way of the engine control system and subsequent successful establishment of communication between the engine control system and the glow control device.

For controlling the heating of the glow plugs of a diesel engine, it is important to know the thermal state of the glow plugs, fast-start glow plugs, in particular, for example, the residual temperature of the glow plugs after previous heating during repeated start and to include it in the following control. The thermal state of the glow plugs can be implemented to date however in the glow plug control system only from experiential values. To consider the residual temperature of the glow plug, knowledge of the entire history is necessary, requiring non-volatile memories and a time basis, in case data have to be included prior to resetting.

Measuring the glow plug temperature via the glow plug resistance is eliminated as a possibility of determining the glow plug temperature based on tolerances of the glow plugs with respect to their resistance course because of the real existing tolerances and the variable dynamic behavior. Calibrating the glow plugs is also not conceivable, as mass-produced components are involved here.

SUMMARY OF THE INVENTION

A primary object of the present invention is to provide a process and a device of the type initially described, with which the heating of the glow plugs of a diesel engine, including the thermal behavior of the glow plugs, can be controlled without using a measuring signal for feeding back the temperature of the glow plugs.

This is solved according to the present invention in the manners described below.

With the process and device according to the present invention, it is possible to consider the thermal situation of the glow plugs, since a physical model of the glow plugs is implemented in the control device. This model, which can be designed, for instance, in the form of a temperature resistance element with positive or negative resistance temperature coefficients, which is heated parallel to the glow plugs with low voltage and minimal current, permits feedback of the current temperature via its resistance. The thermal heating and steady-state behavior of the glow plugs can be emulated in their full dynamic by means of further electronic switching elements.

By the physical model integrated into the glow plug control system, independence of voltage dips on the vehicle is achieved, so that the thermal state of the glow plugs can be determined simply and precisely by the glow plug control, also after full resetting of the electronic control. The temperature range of the glow plug (up to 1100° C. for steel glow plugs, up to 1500° C. for ceramic glow plugs) is preferably projected onto the temperature range of the electronics (up to 125° C.).

This means in detail that a thermal model of the glow plugs is implemented in the glow control system in that electronic control and evaluation is incorporated in connection with a resistance temperature element or a heating element or a combination of both elements. Feedback of the glow plug temperature from the physical model then enables control based thereon or regulating of the glow plugs. The core of the physical model, at the same time, comprises a physical energy storage, whereof the energy content is proportional to the glow plug temperature or is inversely proportional. This physical energy storage can be, for example, a heating element with corresponding thermal mass or a condenser for storing electric energy.

According to the present invention physical modeling of the thermal behavior of the glow plugs results, whereby the corresponding physical model is integrated into the glow control system. This can also include mapping the engine operating state to the physical model.

Operating the glow plugs from every imaginable operating state is thereby optimized to achieve the shortest possible response times to reach the set temperature.

By using a correction module the glow plug temperature is regulated indirectly by a closed control circuit, which leads from the electronic control for controlling the glow plugs, from the correction module, and from the physical model back to the electronic controlling.

The physical model can also be coupled to measuring signals, which, e.g., reflect the ambient temperature or at least the stationary mode of the glow plug. For this purpose, a temperature sensor can be provided in the glow control device or the signal of a temperature sensor of the engine can be evaluated via an interface. For determining the temperature in stationary mode of the glow plug resistance measuring is carried out, and optionally averaging via several or all inbuilt glow plugs.

The device and process according to the present invention furnish improved repeat start protection for fast-start glow plugs and low-voltage glow plugs and offer the possibility of use as a pre-emptive regulator. This means that improved and more precise detection of the actual glow plug temperature, and guiding the glow plug temperature are possible via the more precisely and more easily detectable temperature of the physical model. The imaging and thus storing of the temperature state of the glow plugs is possible independently of the voltage supply of the electronics, so that, after full resetting, the current state of the glow plugs can be detected simply and precisely and optimal control can be selected. The physical model, which is implemented in the electronic control, can be further balanced within the context of manufacturing the electronics. According to the present invention, the memory provided is not static, but dynamic. In this way, the simulation of the cooling behavior is also possible without operating voltage, so that optimal control of the heating procedure of the glow plugs to achieve the shortest possible readiness, i.e., start capability of the engine can be achieved.

A particularly preferred embodiment of the invention will be described in greater detail hereinafter with reference to the attached diagrams, in which:

DETAILED DESCRIPTION OF THE INVENTION

Figure 1:
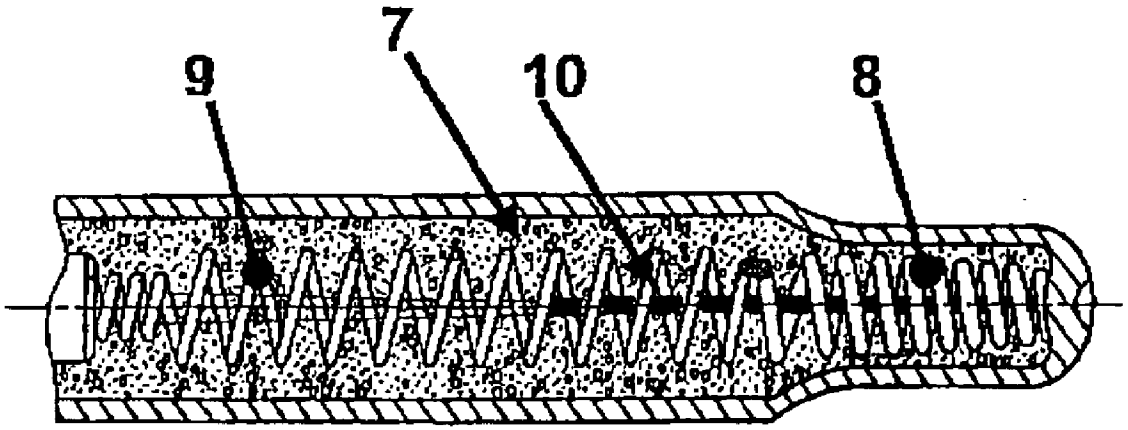
FIG. 1 is a sectional view of the glow rod of a glow plug.
Figure 2:
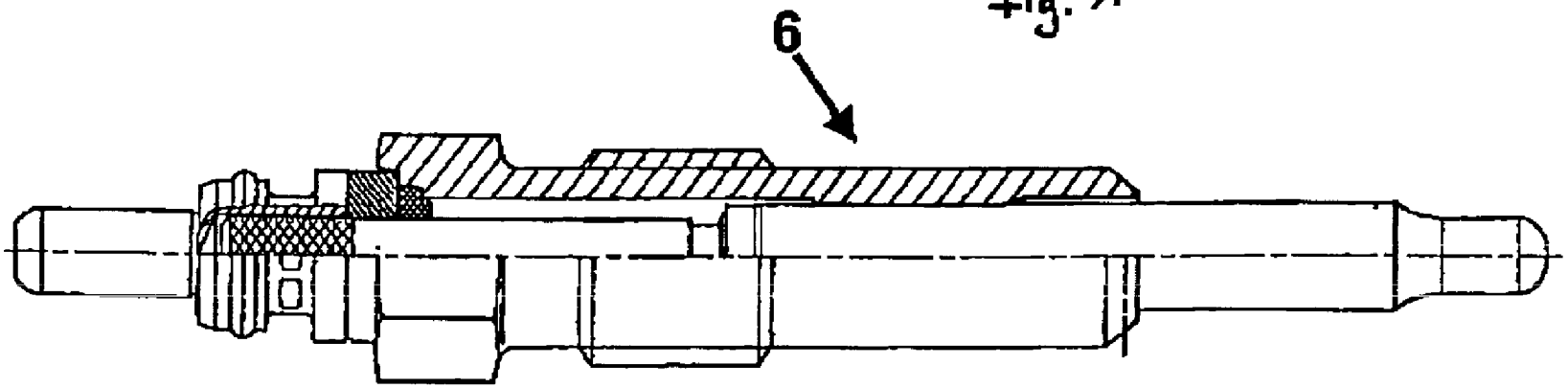
FIG. 2 is a sectional view of a portion of the glow plug with the glow rod illustrated in FIG. 1.

In FIGS. 1 & 2, a standard glow plug made of metal is illustrated, which has variable resistance, which generally rises with increasing temperature. Within the metal glow plug 6, for example, as illustrated in FIG. 2, there is an internal helical combination 7 of a heating element without significant temperature coefficients, namely the heating helix 8, and a heating element with positive temperature coefficients, namely the control or measuring helix 9. Since there is no sufficiently quick thermal coupling, the dynamics at the combustion chamber side core tip can be determined from the change in the resistance, and the abovementioned dynamic follows only relatively passively. In addition, the resistances of all the glow plugs vary widely from mass manufacturing and the resistance course correlates only inadequately with the temperature course. Comparing or sorting all glow plugs is inconceivable due to additional costs. Additional temperature sensors 10 certainly can be provided, though they are associated with high costs and also have a limited life span. Recognizing the heating behavior of the glow plugs thus has tight restrictions placed on it, already partly covered by the tolerance of real glow plugs, so that no additional statement on the present temperature of the glow plugs can be made with statistically distributed resistances.

Direct feedback on the current temperature at the heating rod tip of the glow plugs is thus not possible for serial use.

Figure 3:
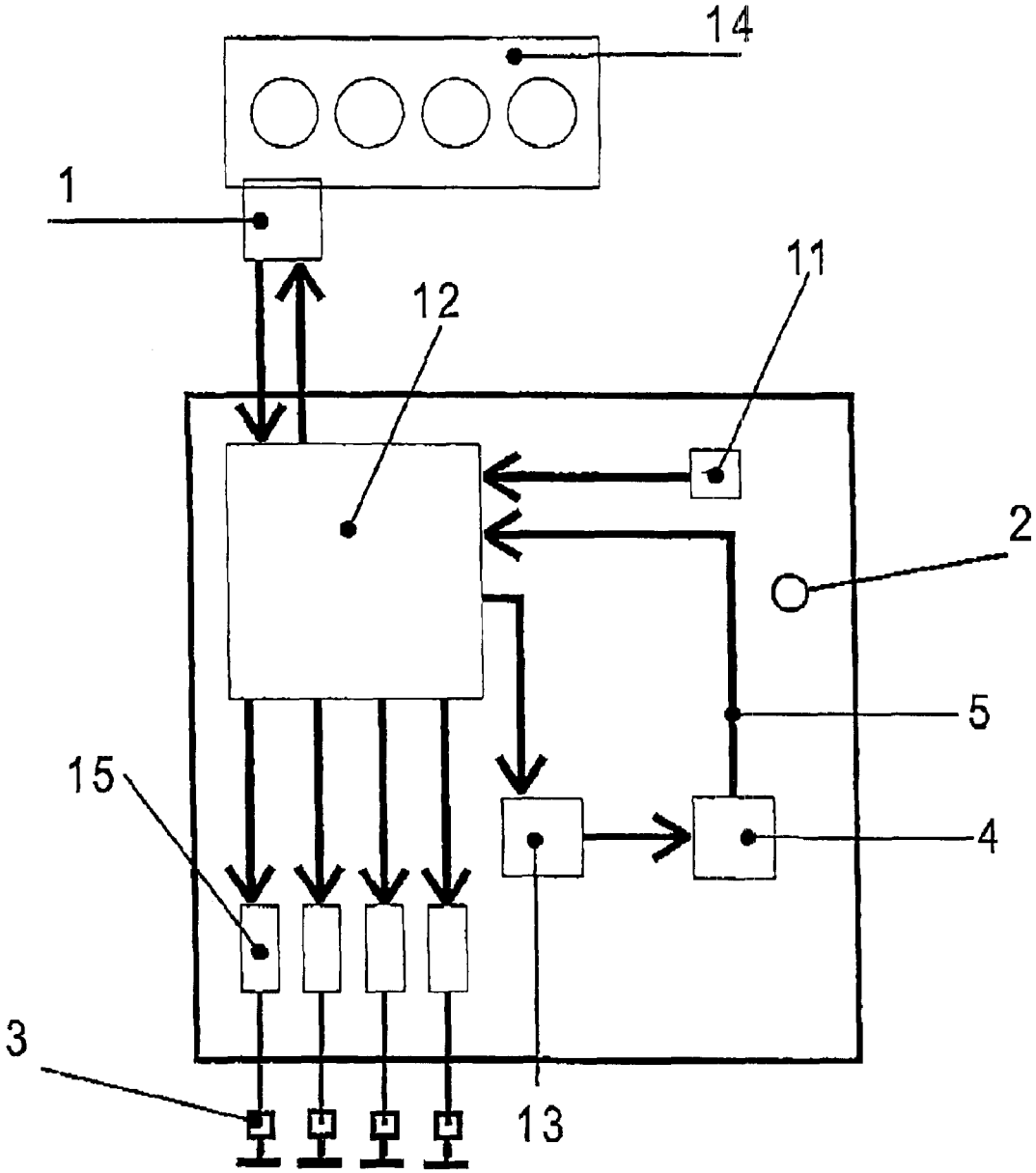
FIG. 3 is a schematic diagram of an embodiment of the device according to the present invention.

As illustrated in FIG. 3, a glow requirement is sent to the glow control system 2, which is interpreted there so that the glow plugs 3 are fed with current according to requirements in a glow plug control system via a suitable interface of an overriding control instrument, for example, the engine control instrument 1 of an engine 14.

As is further shown in FIG. 3, in the illustrated embodiment of the invention, parallel to the glow plugs, a physical model 4 of the glow plugs is provided in the glow control system, the purpose of which is to image the thermal state of the glow plugs 3. This physical model 4 is designed such that it images the temperature at the heating rod tip of a standard glow plug at least when the engine is idle. This applies both for heating and cooling of the glow plug.

The physical model 4, in principle, comprises a physical energy storage, whose energy content is proportional or inversely proportional to the glow plug temperature. This physical energy storage can be, for example, a condenser, whose charged state is proportional to the temperature. The resistance of a correspondingly sized resistance temperature element with positive or negative resistance temperature coefficients inside the physical model can also serve as a measure for the thermal state of the glow plug.

The physical model 4 can also be designed fully in the form of computer-stored software, e.g., as a stored identification field.

As further shown in FIG. 3, the state of the physical model 4 is evaluated and an input value 5 is formed therefrom, which is applied to the glow plug control 12, which controls the glow plugs 3 via a driver 15, e.g., in the form of power switches.

The above described device works as follows.

As soon as a glow requirement is sent to the glow control system 2 via the interface of an overriding control device, for example, the engine control device 1, the glow plugs 3 are triggered, and parallel thereto the physical model 4 in the glow plug control. The state of the model 4 is determined and analyzed and applied as input value 5 at the glow plug control 12 as feedback of the glow plug temperature, so that the glow plug control system 2 can consider the thermal state of the glow plugs when the glow plugs are operated.

The physical model 4 implemented in the glow control system 2 can detect the dynamics very precisely, so that exact information on the temperature actually present on the glow plugs 3 is given, which opens up far-reaching possibilities for detecting and guiding the temperature of the glow plugs 3.

To further heighten the accuracy, the temperature of the physical model 4 can be compared to another temperature, which is recorded at a site which well reflects the ambient temperature. This can be a measuring site 11 on a metal pressed screen, which is not receiving major current, for example, the communications interface.

It is an added advantage that, due to the fact that the physical model 4 is implemented in the glow control system 2, the model or the integrated electronic components can be compared during production of the glow control system 2, by means of which a further increase in accuracy is achieved. Evaluation of the resistance of the glow plugs 3 by measuring the current is inadequate to measure the temperature, in particular in dynamic phases, though in sufficiently stationary phases the resistance of the glow plugs can be compared to the values of the physical model 4, which can serve as further increase in accuracy or for checking plausibility. Corresponding functionality of the control 2 for focused comparison between the glow plug resistance and the output signal of the physical model 4 can be implemented by corresponding software and memory in the electronic drive 12.

The state of the physical model 4 is thus evaluated by appropriate electronics and is made available as a signal for processing for the electronic control 12.

Since the physical model 4, as explained, is operated parallel to the glow plugs 3, i.e., experiences an equivalent or proportional energy input, it simulates the heating behavior of the glow plugs 3. This simulation should be configured such that the heating and cooling behavior is simulated at least when the engine is idle. However, the physical model 4 in the glow control system 2 does not experience the energy supply or discharge as a glow plug in the combustion chamber via the combustion energy or the additional cooling, for example, in thrust mode. So that the physical model 4 fulfils its purpose and simulates the temperature of the glow plugs 3 as best as possible, apart from the parallel triggering of the physical model 4, at the same time, the additional positive or negative energy input can be added mathematically by external influences, which deviate from the standard case. For this, a correcting module 13 is preferably provided which is located between the physical model 4 and the electronic drive 12 and takes into consideration the current engine state, for example, the speed, the torque, the injected quantity of fuel, the temperature etc., and accordingly modifies the control of the physical model 4, such that the reference glow plug temperature output by the model matches the actual glow plug temperature.

For this purpose, in the simplest case, control of the physical model 4 can be limited by a fixed value. It is known that during engine operation glow plugs, at least in diesel engines with direct fuel injection, apart from in peripheral regions of low speed and very high load, have a higher energy requirement compared to the situation, when the engine is idle, to keep the set temperature of the glow plugs. It is normal to design the electronic control 12 such that the energy supply to the glow plugs is regulated such that the glow plug temperature is kept independently of the engine operating conditions. When the engine is running, and thus, as a rule, when the energy flow is higher to the glow plugs than when the engine is idle, it can be assumed that the glow plugs have the set temperature exactly. For these easily detected cases, the correcting module 13 can force the physical model 4 to a state corresponding to the set temperature.

When an even more precise image of the actual glow plug temperature is requested by the physical model 4 or in engines with indirect injection or other engines, in which the abovementioned simple limiting of the model by a fixed value is not sufficient, the additional positive or negative energy input is first detected by a measuring technique and in correlation with parameters available to the engine control device 1 or the glow control system 2, such as e.g., the injected quantity of fuel, the speed, the inner torque, the air, engine, water or oil temperature. Based on the resulting data, an algorithm or a mathematical model is drawn up and integrated into the correcting module 13, so that the latter modifies the control signal parallel to the glow plug current supply, such that the physical model 4 follows the actual temperature on the glow plug. In this way, the temperature of the glow plugs can be regulated advantageously in addition, in that a closed control circuit results from recording the temperature of the physical model 4. Accordingly, overloading, error control etc, are avoided. A set temperature sent, for example, from the engine control device 1 to the glow control system 2 can then be converted relatively easily and monitored, whereby reaching this temperature can be fed back again to the engine control device 1. This opens up further possibilities to bring the glow plugs 3 even faster than previously to the set temperature, because at the time only minimal heating rates are possible due to the deficient feedback of the resulting temperature on the glow plug 3.

What is claimed is:

1. A process for controlling the heating of glow plugs of a diesel engine, comprising the steps of:

emulating the thermal behavior of the glow plugs during both heating and cooling, and using temperature feedback of the emulation as a control value for controlling the heating of the glow plugs;

an electronic control for controlling the heating flow of the glow plugs, wherein said emulating step is performed using a physical model of the glow plugs that is proportional or inversely proportional to glow plug temperature and is provided as a reference signal to the electronic control.

2. The process as claimed in claim 1, wherein the temperature feedback of the emulation is compared to a reference temperature which corresponds to the ambient temperature.

3. The process as claimed in claim 1, wherein the temperature feedback of the emulation is corrected such that it is independent of the engine operating conditions.

4. The process as claimed in claim 3, wherein the correction is carried out by the emulation being limited by a fixed value.

5. The process as claimed in claim 3, wherein the correction is made, during emulation, by detected energy inputs being correlated with available engine operating parameters and being taken into consideration during emulation.

* * * * *